US008979951B2

(12) United States Patent
Siggelkow et al.

(10) Patent No.: US 8,979,951 B2
(45) Date of Patent: Mar. 17, 2015

(54) ADDITIVES FOR IMPROVING THE COLD PROPERTIES OF FUEL OILS

(75) Inventors: Bettina Siggelkow, Frankfurt am Main (DE); Werner Reimann, Frankfurt (DE); Matthias Krull, Harxheim (DE); Markus Kupetz, Dinslaken (DE)

(73) Assignee: Clariant Finance (BVI) Limited, Tortola (VG)

( * ) Notice: Subject to any disclaimer, the term of this patent is extended or adjusted under 35 U.S.C. 154(b) by 883 days.

(21) Appl. No.: 11/879,409

(22) Filed: Jul. 17, 2007

(65) Prior Publication Data

US 2008/0016753 A1 Jan. 24, 2008

(30) Foreign Application Priority Data

Jul. 18, 2006 (DE) ..... 10 2006 033 151

(51) Int. Cl.

| | |
|---|---|
| ***C10L 1/196*** | (2006.01) |
| ***C10M 145/10*** | (2006.01) |
| ***C10L 1/14*** | (2006.01) |
| ***C10L 1/197*** | (2006.01) |
| ***C10L 10/14*** | (2006.01) |
| *C10L 1/195* | (2006.01) |
| *C10L 1/198* | (2006.01) |
| *C10L 1/224* | (2006.01) |

(52) U.S. Cl.

CPC ..... *C10L 1/143* (2013.01); *C10L 1/1973* (2013.01); *C10L 10/14* (2013.01); *C10L 1/195* (2013.01); *C10L 1/1981* (2013.01); *C10L 1/1985* (2013.01); *C10L 1/224* (2013.01)

USPC ..... 44/393; 44/394; 44/395; 508/469; 508/472; 508/585

(58) Field of Classification Search

CPC ... C10L 1/1973; C10L 1/1981; C10L 1/1985; C10L 1/224; C10L 1/143; C10L 1/195; C10L 10/14

USPC ..... 44/393, 395, 389, 394; 508/469, 472, 508/585

See application file for complete search history.

(56) References Cited

U.S. PATENT DOCUMENTS

| | | | | |
|---|---|---|---|---|
| 3,447,915 | A | 6/1969 | Otto | |
| 3,961,916 | A | 6/1976 | Ilnyckyj et al. | |
| 4,178,950 | A | 12/1979 | Sweeney | |
| 4,211,534 | A | 7/1980 | Feldman et al. | |
| 4,670,516 | A | 6/1987 | Sackmann et al. | |
| 5,186,720 | A | 2/1993 | Feustel et al. | |
| 5,391,632 | A | 2/1995 | Krull et al. | |
| 5,766,273 | A | 6/1998 | Dralle-Voss et al. | |
| 5,767,190 | A | 6/1998 | Krull et al. | |
| 6,090,169 | A | 7/2000 | Krull et al. | |
| 6,248,141 | B1 | 6/2001 | Davies et al. | |
| 6,475,250 | B2 * | 11/2002 | Krull et al. | 44/383 |
| 6,509,424 | B1 | 1/2003 | Krull et al. | |
| 6,565,616 | B1 | 5/2003 | Krull et al. | |
| 7,713,316 | B2 | 5/2010 | Krull et al. | |
| 2004/0065004 | A1 | 4/2004 | Krull et al. | |
| 2004/0226216 | A1 * | 11/2004 | Krull et al. | 44/393 |
| 2005/0108924 | A1 * | 5/2005 | Krull | 44/393 |
| 2005/0126070 | A1 * | 6/2005 | Krull | 44/393 |
| 2008/0016754 | A1 | 1/2008 | Siggelkow et al. | |
| 2008/0016755 | A1 | 1/2008 | Siggelkow et al. | |

FOREIGN PATENT DOCUMENTS

| | | | |
|---|---|---|---|
| CA | 2017126 | | 11/1990 |
| CA | 2020571 | | 1/1991 |
| DE | 1924823 | | 12/1969 |
| DE | 1645798 | | 12/1971 |
| DE | 2037673 | | 1/1972 |
| DE | 161128 | | 2/1985 |
| DE | 3501384 | | 7/1986 |
| DE | 19729057 | | 1/1999 |
| EP | 0099646 | | 2/1984 |
| EP | 0154177 | | 9/1985 |
| EP | 0190553 | | 8/1986 |
| EP | 0203554 | | 12/1986 |
| EP | 0217602 | | 4/1987 |
| EP | 0271738 | | 6/1988 |
| EP | 0398101 | | 11/1990 |
| EP | 0406684 | | 1/1991 |
| EP | 0413279 | | 2/1991 |
| EP | 0606055 | | 7/1994 |
| EP | 0741181 | | 11/1996 |
| EP | 0777712 | | 6/1997 |
| EP | 0807642 | | 11/1997 |
| EP | 0890589 | | 1/1999 |
| EP | 0922716 | | 6/1999 |
| EP | 0931825 | | 7/1999 |
| EP | 1146108 | | 10/2001 |
| EP | 1526168 | | 4/2005 |
| GB | 1205772 | | 9/1970 |
| JP | 2005200637 | A * | 7/2005 |
| WO | WO9400537 | | 1/1994 |
| WO | WO9606902 | | 3/1996 |

OTHER PUBLICATIONS

English abstract for DD161128. English abstract for DE1924823.
English abstract for DE2037673.
English abstract for DE3501384.
English abstract for DE19729057.
English abstract for EP0190553.
English abstract for EP0203554.
English abstract for EP0271738.
English abstract for EP0890589.
McCord E.F., et al "Short-Chain Branching Structures in Ethylene Copolymers prepared by High-Pressure Free-Radical Polymerization: An NMR Analysis", Macromolecules, 1997, 30, pp. 246-256.

* cited by examiner

*Primary Examiner* — Ellen McAvoy
*Assistant Examiner* — Latosha Hines
(74) *Attorney, Agent, or Firm* — Tod A. Waldrop

(57) ABSTRACT

The invention provides terpolymers of ethylene, at least one ethylenically unsaturated ester and propene, which a) contain from 12.0 to 16.0 mol % of structural units derived from at least one ethylenically unsaturated ester,
b) contain from 1.0 to 4.0 methyl groups derived from propene per 100 aliphatic carbon atoms, and
c) have fewer than 6.5 methyl groups stemming from chain ends per 100 $CH_2$ groups.

and also their use as cold additives for middle distillates.

19 Claims, No Drawings

ADDITIVES FOR IMPROVING THE COLD PROPERTIES OF FUEL OILS

The present invention relates to ethylene-propene-vinyl ester terpolymers which have improved handling and improved performance properties as cold additives for fuel oils.

Crude oils and middle distillates, such as gas oil, diesel oil or heating oil, obtained by distillation of crude oils contain, depending on the origin of the crude oils, different amounts of n-paraffins which crystallize out as platelet-shaped crystals when the temperature is reduced and sometimes agglomerate with inclusion of oil. This crystallization and agglomeration causes a deterioration in the flow properties of the oils or distillates, which may result in disruption in the course of extraction, transport, storage and/or use of the mineral oils and mineral oil distillates. When mineral oils are transported through pipelines, the crystallization phenomenon can, especially in winter, lead to deposits on the pipe walls and, in individual cases, for example in the event of stoppage of a pipeline, even to its complete blockage. In the storage and further processing of the mineral oils, it may also be necessary in winter to store the mineral oils in heated tanks in order to ensure their flowability. In the case of mineral oil distillates, the consequence of crystallization may be blockages of the filters in diesel engines and boilers, which prevents reliable metering of the fuels and, under some circumstances, results in complete interruption of the fuel or heating medium supply.

In addition to the classical methods of eliminating the crystallized paraffins (thermally, mechanically or with solvents), which merely involve the removal of the precipitates which have already formed, chemical additives (known as flow improvers) have been developed in recent years. The additives act as additional crystal seeds and partly crystallize out with the paraffins, which forms a larger number of smaller paraffin crystals with modified crystal form. The modified paraffin crystals have a lesser tendency to agglomerate, so that the oils admixed with these additives can still be pumped and processed at temperatures which are often more than 20° C. lower than in the case of nonadditized oils.

A further task of flow improvers is the dispersion of paraffin crystals, i.e. the delay or prevention of sedimentation of paraffin crystals and hence the formation of a paraffin-rich layer at the bottom of storage containers.

A known additive class which is used in many cases for the improvement of the cold properties of mineral oils and middle distillates produced therefrom is that of copolymers of ethylene and vinyl esters, especially ethylene and vinyl acetate ("EVA"). The polymers are partly crystalline polymers whose mode of action is explained by cocrystallization of their poly(ethylene) sequences with the n-paraffins which precipitate out of the middle distillates in the course of cooling. This physical interaction modifies shape, size and adhesion properties of the precipitating paraffin crystals to the effect that many small crystals form, which pass through the fuel filter and can be fed to the combustion chamber. Owing to their crystallinity, these ethylene-vinyl ester copolymers have to be handled and dosed at elevated temperature or alternatively made handleable by means of high dilution with solvents.

There are, however, also fields of use, for example storage tanks in terminals or remote areas, in which these additives stored under ambient conditions have to be added directly to the oils to be additized and in particular cold oils for the lack of means of preheating oil and/or additive. In this case, there is the risk that the additives remain undissolved, as a result of which they cannot display their effect and may additionally themselves be the cause of filter coverage and filter blockage.

It is also known that the intrinsic flowability of ethylene-vinyl ester copolymers and their dispersions can be improved by a high proportion of so-called short-chain branches, as can be established, for example, by polymerization at high temperatures and/or low pressures. These short-chain branches form through intramolecular chain transfer reactions ("backbiting mechanism") during the free-radical chain polymerization and consist essentially of butyl and ethyl radicals (see, for example, Macromolecules 1997, 30, 246-256). However, these short-chain branches reduce the effectiveness of these polymers as cold additives significantly.

Structures comparable to the short-chain branches and associated effects are obtained by the incorporation of branched comonomers such as isobutylene (EP-A-0 099 646), 4-methylpentene (EP-A-0 807 642) or diisobutylene (EP-A-0 203 554) in EVA copolymers. Although an improvement in the flowability and the solubility of the polymers is observed with increasing incorporation of these monomers, their effectiveness as a cold additive also falls simultaneously.

EP-A-0 190 553 discloses terpolymers of ethylene, 20-40% by weight of vinyl acetate and propene, which have a degree of branching of from 8 to 25 $CH_3$/100 $CH_2$ groups. The examples disclose polymers with from 25.7 to 29.1% by weight of vinyl acetate and degrees of branching of from 14 to 20 $CH_3$/100 $CH_2$ groups, whose molecular weight was adjusted solely by the moderating action of propene. Alone, they exhibit barely any effectiveness as cold flow improvers and are used to improve the solubility of conventional EVA copolymers.

EP-A-0 406 684 discloses polymer mixtures which may contain ethylene-vinyl acetate co- and terpolymers with a vinyl acetate content of 25-35% by weight and a degree of branching of from 3 to 15 $CH_3$ groups. The terpolymers may contain from 5 to 15% by weight of olefins, for example propene. The examples demonstrate an EVA terpolymer with diisobutylene.

DD-A-161 128 discloses a process for preparing a flow improver for middle distillates in a high-pressure bulk process, in which ethylene is polymerized with 10-50% by mass of vinyl acetate and from 0.1 to 10 mol % of an n-alkene having from 3 to 8 carbon atoms in the presence of hydrogen as a moderator. The high polymerization temperature of 265° C. demonstrated in the examples, however, causes a high proportion of short-chain branches with only a very low content of propene of less than 1 mol %

Although it is possible to improve the intrinsic flowability of polymers by virtue of short-chain branches or else by virtue of relatively long-chain and especially branched olefin comonomers, this is often accompanied by a loss in activity, since the optimal range of the poly(ethylene) sequence lengths for cocrystallization with paraffins is departed from, and even relatively small amounts of the comonomers bring about such great disruption to the polyethylene sequences that effective cocrystallization with the paraffins of the oil is no longer possible.

The incorporation of relatively large amounts of the known branched olefins such as isobutylene, 4-methylpentene or isobutylene into polymers of ethylene and unsaturated esters is additionally restricted by the fact that these olefins have such a strong moderating effect on the polymerization that the requirement for initiators reaches a level prohibitive for commercial applications and/or a conversion of commercial interest cannot be achieved in the polymerization. In addition, the resulting highly short chain-branched products do not exhibit sufficient effectiveness as flow improvers.

It was consequently an object of the present invention to provide additives which are free-flowing and pumpable without any problem at temperatures of, for example, below −10° C., for example below −15° C., in particular below −20° C. and in special cases even below −25° C., in highly concentrated form, i.e. in formulations having at least 20% by weight, preferably at least 25% by weight and especially at least 30% by weight, for example at least 35% by weight of polymer in a solvent, dissolve without residue in fuel oils at these temperatures and exhibit identical or improved effectiveness compared to the prior art additives.

It has now been found that concentrates of terpolymers of ethylene, propene and vinylic, acrylic and/or methacrylic esters with a specific content of comonomers, short-chain branches and methyl groups derived from propene exhibit very good handling in cold conditions and simultaneously superior effectiveness as cold additives. It is of particular significance in this context that the propylene is incorporated into the polymer chain as a comonomer and is bonded to the chain end not only in the sense of a moderator. In addition, these polymers can be prepared in conventional plants with commercially interesting conversions.

The invention thus provides terpolymers of ethylene, at least one ethylenically unsaturated ester and propene, which a) contain from 12.0 to 16.0 mol % of structural units derived from at least one ethylenically unsaturated ester,
b) contain from 1.0 to 4.0 methyl groups derived from propene per 100 aliphatic carbon atoms, and
c) has fewer than 6.5 methyl groups stemming from chain ends per 100 $CH_2$ groups.

The invention further provides free-flowing additive concentrates having an intrinsic pour point of −15° C. or lower, containing at least 20% by weight of at least one terpolymer of ethylene, at least one unsaturated ester and propene as defined above in organic solvent.

The invention further provides for the use of a terpolymer of ethylene, at least one unsaturated ester and propene as defined above for improving the cold flowability of middle distillates.

The invention further provides a process for improving the cold flowability of middle distillates by adding to the middle distillate at temperatures below 0° C. an additive concentrate containing at least 20% by weight of at least one terpolymer of ethylene, at least one unsaturated ester and propene as defined above with a temperature of 0° C. or lower.

Unsaturated esters suitable in accordance with the invention are in particular vinyl esters of carboxylic acids having from 2 to 12 carbon atoms and esters of acrylic and methacrylic acid with fatty alcohols having from 1 to 12 carbon atoms.

Particularly preferred ethylenically unsaturated esters are vinyl esters of carboxylic acids having from 2 to 12 carbon atoms. They are preferably those of the formula 1

$$CH_2{=}CH{-}OCOR^1 \quad (1)$$

in which $R^1$ is $C_1$- to $C_{11}$-alkyl, preferably $C_1$- to $C_8$-alkyl and especially $C_1$- to $C_4$-alkyl. The alkyl radicals may be linear or branched. Preferred branched alkyl radicals bear a branch in the 1- or 2-position to the carbonyl group. Examples of suitable vinyl esters are vinyl acetate, vinyl propionate, vinyl butyrate, vinyl isobutyrate, vinyl pentanoate, vinyl pivalate, vinyl n-hexanoate, vinyl 2-ethylhexanoate, vinyl neononanoate, vinyl neodecanoate and vinyl neoundecanoate. Vinyl esters of short-chain fatty acids having from 1 to 4 carbon atoms are particularly preferred. Vinyl acetate is especially preferred.

Further preferred ethylenically unsaturated esters are esters of acrylic and methacrylic acid with fatty alcohols having from 1 to 12 carbon atoms. They are preferably those of the formula 2

$$CH_2{=}CR^2{-}COOR^3 \quad (2)$$

in which $R^2$ is hydrogen or methyl and $R^3$ is $C_1$- to $C_{12}$-alkyl, preferably $C_1$- to $C_8$-alkyl, especially $C_1$- to $C_6$-alkyl, for example $C_1$- to $C_4$-alkyl. Suitable acrylic esters include, for example, methyl(meth)acrylate, ethyl (meth)acrylate, propyl(meth)acrylate, n- and isobutyl (meth)acrylate, hexyl, octyl, 2-ethyhexyl(meth)acrylate, and mixtures of these comonomers. Methyl acrylate and ethyl acrylate are particularly preferred.

The content in the terpolymers of unsaturated ester is preferably between 12.0 and 15.5 mol %, for example between 12.5 and 15.0 mol %. In the case of the vinyl acetate which is particularly preferred as the ethylenically unsaturated ester, the content is preferably between 28.0 and 36.0% by weight, in particular between 29.5 and 35.0% by weight, for example between 31.0 and 34.0% by weight. The vinyl ester content is determined by means of pyrolysis of the polymer and subsequent titration of the eliminated carboxylic acid.

The content in the polymer of methyl groups which derive from propene is preferably between 1.5 and 3.8 and in particular between 1.8 and 3.5 methyl groups per 100 aliphatic carbon atoms.

The content in the inventive polymers of methyl groups derived from propene (propene-$CH_3$) is determined by means of $^{13}C$ NMR spectroscopy. For instance, terpolymers of ethylene, vinyl ester and propene exhibit characteristic signals of methyl groups bonded to the polymer backbone between about 19.3 and 20.2 ppm, which have a positive sign in the DEPT experiment. The integral of this signal of the methyl side groups of the polymer backbone which are derived from propene is determined relative to that of all other aliphatic carbon atoms of the polymer backbone between about 22.0 and 44 ppm. Any signals which stem from the alkyl radicals of the unsaturated esters and overlap with the signals of the polymer backbone are subtracted from the total integral of the aliphatic carbon atoms on the basis of the signal of the methine group adjacent to the carbonyl group of the unsaturated ester. Such measurements can be performed, for example, with NMR spectrometers at a measurement frequency of 125 MHz at 30° C. in solvents such as $CDCl_3$ or $C_2D_2Cl_4$.

The number of methyl groups stemming from chain ends in the polymers is preferably between 2.0 and 6.0 $CH_3$/100 $CH_2$ groups and in particular between 3.0 and 5.5 $CH_3$/100 $CH_2$ groups.

The number of methyl groups stemming from chain ends is understood to mean all of those methyl groups of the polymer which do not stem from the unsaturated esters used as comonomers. This is consequently understood to mean both the methyl groups present on the main chain ends including the methyl groups derived from structural units of the moderator and the methyl groups stemming from short-chain branches.

The number of methyl groups stemming from chain ends is determined by means of $^1H$ NMR spectroscopy by determining the integral of the signals of the methyl protons which appear in the $^1H$ NMR spectrum typically at a chemical shift between about 0.7 and 0.9 ppm (relative to TMS) relative to the integral of the signals of the methylene protons which appear at from 0.9 to 1.9 ppm. The methyl and methylene groups stemming from alkyl radicals of the comonomers, for example the acetyl group of vinyl acetate, are not included or are eliminated from the calculation. The signals caused by structural units of the moderators are accordingly attributable to the methyl or methylene protons. The number of methyl groups stemming from propene, which has been determined by means of $^{13}C$ NMR spectroscopy, is subtracted from the resulting value in order to obtain the number of methyl groups stemming from chain ends. Suitable $^{1}H$ NMR spectra can be recorded, for example, at a measurement frequency of 500 MHz at 30° C. in solvents such as $CDCl_3$ or $C_2D_2Cl_4$.

The sum G of molar content of unsaturated ester a) and the number of methyl groups derived from propene per 100 aliphatic carbon atoms of the polymer b)

$$G=[\text{mol \% of unsaturated ester}]+[\text{propene-}CH_3]$$

is preferably between 14.5 and 18.0, preferably between 15.0 and 17.8, for example between 15.5 and 17.5. The two summands should be added as dimensionless numbers.

The weight-average molecular weight Mw of the inventive terpolymers, which is determined by means of gel permeation chromatography against poly(styrene) standards is preferably between 1000 and 25 000 g/mol, preferably between 2000 and 20 000 g/mol, for example between 2500 and 15 000 g/mol. The polydispersity of the polymers is preferably less than 8, for example from 2 to 6. The melt viscosity of the inventive polymers determined at 140° C. is between 50 and 5000 mPas, preferably between 80 and 2500 mPas and in particular between 100 and 1000 mPas.

For all analyses, the polymer of interest is freed beforehand of residual monomers and any solvent fractions at 140° C. under reduced pressure (100 mbar) for two hours.

The inventive copolymers are preparable by suspension polymerization, solvent polymerization, gas phase polymerization or high-pressure bulk polymerization. Preference is given to performing high-pressure bulk polymerization at pressures above 100 MPa, preferably between 100 and 300 MPa, for example between 150 and 275 MPa, and temperatures of from 100 to 260° C., preferably from 150 to 240° C., for example between 180 and 220° C. Suitable selection of the reaction conditions and of the amounts of monomers used allows the propene content and also the extent of the short-chain branches to be established. Thus, low reaction temperatures and/or high pressures in particular lead to low proportions of short-chain branches and hence to a low number of chain ends.

The reaction of the monomers is induced by free-radical-forming initiators (free-radical chain starters). This substance class includes, for example, oxygen, hydroperoxides, peroxides and azo compounds, such as cumene hydroperoxide, t-butyl hydroperoxide, dilauroyl peroxide, dibenzoyl peroxide, bis(2-ethylhexyl)peroxodicarbonate, t-butyl perpivalate, t-butyl permaleate, t-butyl perbenzoate, dicumyl peroxide, t-butyl cumyl peroxide, di(t-butyl)peroxide, 2,2'-azobis(2-methyl-propanonitrile), 2,2'-azobis(2-methylbutyronitrile). The initiators are used individually or as a mixture of two or more substances in amounts of from 0.01 to 10% by weight, preferably from 0.05 to 5% by weight, based on the monomer mixture.

The high-pressure bulk polymerization is performed in known high-pressure reactors, for example autoclaves or tubular reactors, batchwise or continuously; particularly useful reactors have been found to be continuous tubular reactors. Solvents such as aliphatic and/or aromatic hydrocarbons or hydrocarbon mixtures, benzene or toluene, may be present in the reaction mixture. Preference is given to the essentially solvent-free procedure. In a preferred embodiment of the polymerization, the mixture of the monomers, the initiator and, when used, the moderator is fed to a tubular reactor via the reactor inlet and via one or more side branches. The comonomers and also the moderators may be metered into the reactor either together with ethylene or separately via side-streams. In this case, the monomer streams may have different composition (EP-A-0 271 738 and EP-A-0 922 716).

It has been found to be advantageous to adjust the molecular weight of the polymers not solely via the moderating action of the propene but additionally to use moderators which essentially bring about only one chain transfer and are not incorporated into the polymer chains in the manner of comonomers. Methyl groups can thus be incorporated selectively into the polymer backbone as disruption sites by the use of propene, and polymers with improved effectiveness as cold flow improvers are obtained. Preferred moderators are, for example, saturated and unsaturated hydrocarbons, for example propane, hexane, heptane and cyclohexane, and also alcohols, for example butanol, and especially aldehydes, for example acetaldehyde, propionaldehyde, n-butyraldehyde and isobutyraldehyde and also ketones, for example acetone, methyl ethyl ketone, methyl propyl ketone, methyl isopropyl ketone, methyl butyl ketone, methyl isobutyl ketone and cyclohexanone. Hydrogen is also suitable as a moderator.

In a particularly preferred embodiment, the inventive polymers, in addition to vinyl ester and propene, contain from 0.5 to 7.0% by weight, preferably from 1.0 to 5.0% by weight, of structural units which derive from moderator containing at least one carbonyl group. The concentration of these structural elements derived from the moderator in the polymer can likewise be determined by means of $^{1}H$ NMR spectroscopy. This can be effected, for example, by correlating the intensity of the signals stemming from the vinyl ester, whose proportion in the polymer is known, with the signals of the methylene or methine group adjacent to the carbonyl group of the moderators, which appears at from about 2.4 to 2.5 ppm.

For the purpose of better handling, the inventive polymers are typically used in the form of concentrates in organic solvents. Suitable solvents or dispersants are, for example, relatively high-boiling aliphatic hydrocarbons, aromatic hydrocarbons, alcohols, esters, ethers and mixtures thereof. The inventive additives preferably contain from 10 to 90% by weight, in particular from 20 to 80% by weight and especially from 50 to 75% by weight, for example from 60 to 70% by weight, of solvent.

It has been found that, surprisingly, the intrinsic pour point of the inventive terpolymers, in the case of dilution to an active substance content of below 40% by weight, preferably from 20 to 40% by weight, in particular to from 25 to 40% by weight, for example to from 30 to 35% by weight of active ingredient falls much more significantly than in the case of prior art polymers. This effect is particularly marked in predominantly aromatic solvents and solvent mixtures. Concentrates having intrinsic pour points of −30° C. and lower are thus obtained. At the same time, the effectiveness of the inventive polymers is superior to those of the prior art at the same additive concentration in the additized oil. Surprisingly, such concentrates of the inventive terpolymers can also be mixed without any problem in fuel oils with temperatures of below 0° C., for example below −10° C. and in some cases below −25° C., without there being any impairment of filterability, which is known from conventional additives, of the additized fuel oils as a result of undissolved fractions of the additive. It is thus possible with the inventive additives to improve the cold flow properties of fuel oils even without preceding heating of oil and/or additive.

The inventive polymers find use as additives for mineral oil distillates alone or in a mixture with other constituents; hereinafter, they are therefore also referred to as inventive additives.

The inventive additives can be added to middle distillates to improve the cold flowability also in combination with further additives, for example further ethylene copolymers, polar nitrogen compounds, alkylphenol-aldehyde resins, comb polymers, polyoxyalkylene compounds and/or olefin copolymers.

When the inventive additives are used for middle distillates, they comprise, in a preferred embodiment, one or more of constituents II to VII as well as the inventive terpolymers.

They thus preferably comprise one or more further copolymers of ethylene and olefinically unsaturated compounds, in particular unsaturated esters, as constituent II. Suitable ethylene copolymers are in particular those which, as well as ethylene, contain from 6 to 21 mol %, in particular from 10 to 18 mol %, of comonomers.

The olefinically unsaturated compounds are preferably vinyl esters, acrylic esters, methacrylic esters, alkyl vinyl ethers and/or alkenes, and the compounds mentioned may be substituted by hydroxyl groups. One or more comonomers may be present in the polymer.

The vinyl esters are preferably those of the formula 3

$$CH_2{=}CH{-}OCOR^{11} \quad (3)$$

where $R^{11}$ is $C_1$- to $C_{30}$-alkyl, preferably $C_4$- to $C_{16}$-alkyl, especially $C_6$- to $C_{12}$-alkyl. In a further embodiment, the alkyl groups mentioned may be substituted by one or more hydroxyl groups.

In a further preferred embodiment, $R^{11}$ is a branched alkyl radical or a neoalkyl radical having from 7 to 11 carbon atoms, in particular having 8, 9 or 10 carbon atoms. Particularly preferred vinyl esters derive from secondary and especially tertiary carboxylic acids whose branch is in the alpha-position to the carbonyl group. Suitable vinyl esters include vinyl acetate, vinyl propionate, vinyl butyrate, vinyl isobutyrate, vinyl hexanoate, vinyl heptanoate, vinyl octanoate, vinyl pivalate, vinyl 2-ethylhexanoate, vinyl laurate, vinyl stearate and Versatic esters such as vinyl neononanoate, vinyl neodecanoate, vinyl neoundecanoate.

In a further preferred embodiment, these ethylene copolymers contain vinyl acetate and at least one further vinyl ester of the formula 3 where $R^{11}$ is $C_4$- to $C_{30}$-alkyl, preferably $C_4$- to $C_{16}$-alkyl, especially $C_6$- to $C_{12}$-alkyl.

The acrylic esters are preferably those of the formula 4

$$CH_2{=}CR^2{-}COOR^4 \quad (4)$$

where $R^2$ is hydrogen or methyl and $R^4$ is $C_1$- to $C_{30}$-alkyl, preferably $C_4$- to $C_{16}$-alkyl, especially $C_6$- to $C_{12}$-alkyl. Suitable acrylic esters include, for example, methyl (meth)acrylate, ethyl(meth)acrylate, propyl(meth)acrylate, n- and isobutyl(meth)acrylate, hexyl, octyl, 2-ethylhexyl, decyl, dodecyl, tetradecyl, hexadecyl, octadecyl (meth)acrylate and mixtures of these comonomers. In a further embodiment, the alkyl groups mentioned may be substituted by one or more hydroxyl groups. An example of such an acrylic ester is hydroxyethyl methacrylate.

The alkyl vinyl ethers are preferably compounds of the formula 5

$$CH_2{=}CH{-}OR^5 \quad (5)$$

where $R^5$ is $C_1$- to $C_{30}$-alkyl, preferably $C_4$- to $C_{16}$-alkyl, especially $C_6$- to $C_{12}$-alkyl. Examples include methyl vinyl ether, ethyl vinyl ether, isobutyl vinyl ether. In a further embodiment, the alkyl groups mentioned may be substituted by one or more hydroxyl groups.

The alkenes are preferably monounsaturated hydrocarbons having from 3 to 30 carbon atoms, in particular from 4 to 16 carbon atoms and especially from 5 to 12 carbon atoms. Suitable alkenes include propene, butene, isobutylene, pentene, hexene, 4-methylpentene, octene, diisobutylene and norbornene and derivatives thereof such as methylnorbornene and vinylnorbornene. In a further embodiment, the alkyl groups mentioned may be substituted by one or more hydroxyl groups.

Apart from ethylene, particularly preferred terpolymers of vinyl 2-ethylhexanoate, of vinyl neononanoate or of vinyl neodecanoate preferably contain from 3.5 to 20 mol %, in particular from 8 to 15 mol %, of vinyl acetate, and from 0.1 to 12 mol %, in particular from 0.2 to 5 mol %, of the particular long-chain vinyl ester, the total comonomer content being between 8 and 21 mol %, preferably between 12 and 18 mol %. Further particularly preferred copolymers contain, in addition to ethylene and from 8 to 18 mol % of vinyl esters, also from 0.5 to 10 mol % of olefins such as propene, butene, isobutylene, hexene, 4-methylpentene, octene, diisobutylene and/or norbornene.

These ethylene co- and terpolymers preferably have melt viscosities at 140° C. of from 20 to 10 000 mPas, in particular from 30 to 5000 mPas, especially from 50 to 2000 mPas. The degrees of branching determined by means of $^1H$ NMR spectroscopy are preferably between 1 and 9 $CH_3$/100 $CH_2$ groups, in particular between 2 and 6 $CH_3$/100 $CH_2$ groups, which do not stem from the comonomers.

In the case of mixtures of the inventive additives with ethylene copolymers (constituent II), the polymers forming the basis of the mixtures differ in at least one characteristic. For example, they may contain different comonomers, different comonomer contents, molecular weights and/or degrees of branching. For example, particularly useful mixtures have been found to be those in which the total comonomer content (the content of monomers apart from ethylene) of the further ethylene copolymer is at least two, in particular at least three mol % lower than that of the inventive additive. In addition, particularly useful mixtures have been found to be those in which the mean molecular weight Mw of the further ethylene copolymer is at least 500 g/mol and especially at least 1000 g/mol higher than that of the inventive additive.

The mixing ratio between the inventive additives and ethylene copolymers as constituent II may, according to the application, vary within wide limits, the inventive additives often constituting the larger proportion. Such additive mixtures preferably contain from 30 to 98% by weight, preferably from 50 to 97% by weight and especially from 70 to 95% by weight of the inventive additives, and from 2 to 70% by weight, preferably from 3 to 50% by weight and especially from 5 to 20% by weight of ethylene copolymers (constituent II).

The suitable oil-soluble polar nitrogen compounds (constituent III) are preferably reaction products of fatty amines with compounds which contain an acyl group. The preferred amines are compounds of the formula $NR^6R^7R^8$ where $R^6$, $R^7$ and $R^8$ may be the same or different, and at least one of these groups is $C_8$-$C_{36}$-alkyl, $C_6$-$C_{36}$-cycloalkyl or $C_8$-$C_{36}$-alkenyl, in particular $C_{12}$-$C_{24}$-alkyl, $C_{12}$-$C_{24}$-alkenyl or cyclohexyl, and the remaining groups are either hydrogen, $C_1$-$C_{36}$-alkyl, $C_2$-$C_{36}$-alkenyl, cyclohexyl, or a group of the formulae $-(A\text{-}O)_x\text{-}E$ or $-(CH_2)_n-NYZ$, where A is an ethyl or propyl group, x is a number from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or $-(A\text{-}O)_x$. The alkyl and alkenyl radicals may each be linear or branched and contain up to two double bonds. They are preferably linear and substantially saturated, i.e. they have iodine numbers of less than 75 g of $I_2$/g, preferably less than 60 g of $I_2$/g and in particular between 1 and 10 g of $I_2$/g. Particular preference is given to secondary fatty amines in which two of the $R^6$, $R^7$ and $R^8$ groups are each $C_8$-$C_{36}$-alkyl, $C_6$-$C_{36}$-cycloalkyl, $C_8$-$C_{36}$-alkenyl, in particular $C_{12}$-$C_{24}$-alkyl, $C_{12}$-$C_{24}$-alkenyl or cyclohexyl. Suitable fatty amines are, for example, octylamine, decylamine, dodecylamine, tetradecylamine, hexadecylamine, octadecylamine, eicosylamine, behenylamine, didecylamine, didodecylamine, ditetradecylamine, dihexadecylamine, dioctadecylamine, dieicosylamine, dibehenylamine and mixtures thereof. The amines especially contain chain cuts based on natural raw materials, for example coconut fatty amine, tallow fatty amine, hydrogenated tallow fatty amine, dicoconut fatty amine, ditallow fatty amine and di(hydrogenated tallow fatty amine). Particularly preferred amine derivatives are amine salts, imides and/or amides, for example amide-ammonium salts of secondary fatty amines, in particular of dicoconut fatty amine, ditallow fatty amine and distearylamine.

Acyl group is understood here to mean a functional group of the following formula:

>C=O

Carbonyl compounds suitable for the reaction with amines are either monomeric or polymeric compounds having one or more carboxyl groups. Preference is given to those monomeric carbonyl compounds having 2, 3 or 4 carbonyl groups. They may also contain heteroatoms such as oxygen, sulfur and nitrogen. Suitable carboxylic acids are, for example, maleic acid, fumaric acid, crotonic acid, itaconic acid, succinic acid, $C_1$-$C_{40}$-alkenylsuccinic acid, adipic acid, glutaric acid, sebacic acid and malonic acid, and also benzoic acid, phthalic acid, trimellitic acid and pyromellitic acid, nitrilotriacetic acid, ethylenediaminetetraacetic acid and their reactive derivatives, for example esters, anhydrides and acid halides. Useful polymeric carbonyl compounds have been found to be in particular copolymers of ethylenically unsaturated acids, for example acrylic acid, methacrylic acid, maleic acid, fumaric acid and itaconic acid; particular preference is given to copolymers of maleic anhydride. Suitable comonomers are those which impart oil solubility to the copolymer. Oil-soluble means here that the copolymer, after reaction with the fatty amine, dissolves without residue in the middle distillate to be additized in practically relevant dosages. Suitable comonomers are, for example, olefins, alkyl esters of acrylic acid and methacrylic acid, alkyl vinyl esters, alkyl vinyl ethers having from 2 to 75, preferably from 4 to 40 and in particular from 8 to 20, carbon atoms in the alkyl radical. In the case of olefins, the carbon number is based on the alkyl radical attached to the double bond. The molecular weights of the polymeric carbonyl compounds are preferably between 400 and 20 000, more preferably between 500 and 10 000, for example between 1000 and 5000.

It has been found that particularly useful oil-soluble polar nitrogen compounds are those which are obtained by reaction of aliphatic or aromatic amines, preferably long-chain aliphatic amines, with aliphatic or aromatic mono-, di-, tri- or tetracarboxylic acids or their anhydrides (cf. U.S. Pat. No. 4,211,534). Equally suitable as oil-soluble polar nitrogen compounds are amides and ammonium salts of aminoalkylenepolycarboxylic acids such as nitrilotriacetic acid or ethylenediaminetetraacetic acid with secondary amines (cf. EP 0 398 101). Other oil-soluble polar nitrogen compounds are copolymers of maleic anhydride and α,β-unsaturated compounds which may optionally be reacted with primary monoalkylamines and/or aliphatic alcohols (cf. EP-A-0 154 177, EP 0 777 712), the reaction products of alkenyl-spirobislactones with amines (cf. EP-A-0 413 279 B1) and, according to EP-A-0 606 055 A2, reaction products of terpolymers based on α,β-unsaturated dicarboxylic anhydrides, α,β-unsaturated compounds and polyoxyalkylene ethers of lower unsaturated alcohols.

The mixing ratio between the inventive additives and oil-soluble polar nitrogen compounds as constituent III may vary depending upon the application. Such additive mixtures preferably contain, based on the active ingredients, from 0.1 to 10 parts by weight, preferably from 0.2 to 5 parts by weight, of at least one oil-soluble polar nitrogen compound per part by weight of the inventive additive.

Suitable alkylphenol-aldehyde resins as constituent IV are in particular those alkylphenol-aldehyde resins which derive from alkylphenols having one or two alkyl radicals in the ortho- and/or para-position to the OH group. Particularly preferred starting materials are alkylphenols which bear, on the aromatic, at least two hydrogen atoms capable of condensation with aldehydes, and in particular monoalkylated phenols. The alkyl radical is more preferably in the para-position to the phenolic OH group. The alkyl radicals (for constituent IV, this is generally understood to mean hydrocarbon radicals as defined below) may be the same or different in the alkylphenol-aldehyde resins usable with the inventive additives. The alkyl radicals may be saturated or unsaturated. They may be linear or branched, preferably linear. They have 1-200, preferably 1-24, in particular 4-16, for example 6-12 carbon atoms; they are preferably n-, iso- and tert-butyl, n- and isopentyl, n- and isohexyl, n- and isooctyl, n- and isononyl, n- and isodecyl, n- and isododecyl, tetradecyl, hexadecyl, octadecyl, tripropenyl, tetrapropenyl, poly(propenyl) and poly(isobutenyl) radicals. Particularly suitable alkylphenol-aldehyde resins are derived from linear alkyl radicals having 8 and 9 carbon atoms. In a preferred embodiment, the alkylphenol resins are prepared by using mixtures of alkylphenols with different alkyl radicals. For example, resins based firstly on butylphenol and secondly on octyl-, nonyl- and/or dodecylphenol in a molar ratio of from 1:10 to 10:1 have been found to be particularly useful.

Suitable alkylphenol resins may also contain or consist of structural units of further phenol analogs such as salicylic acid, hydroxybenzoic acid and derivatives thereof, such as esters, amides and salts.

Suitable aldehydes for the alkylphenol-aldehyde resins are those having from 1 to 12 carbon atoms and preferably having from 1 to 4 carbon atoms, for example formaldehyde, acetaldehyde, propionaldehyde, butyraldehyde, 2-ethylhexanal, benzaldehyde, glyoxalic acid and their reactive equivalents such as paraformaldehyde and trioxane. Particular preference is given to formaldehyde in the form of paraformaldehyde and especially formalin.

The molecular weight of the alkylphenol-aldehyde resins, measured by means of gel permeation chromatography against poly(styrene) standards in THF, is preferably 500-25 000 g/mol, more preferably 800-10 000 g/mol and especially 1000-5000 g/mol, for example 1500-3000 g/mol. A prerequisite here is that the alkylphenol-aldehyde resins are oil-soluble at least in concentrations relevant to use of from 0.001 to 1% by weight.

In a preferred embodiment of the invention, they are alkylphenol-formaldehyde resins which contain oligo- or polymers with a repeat structural unit of the formula

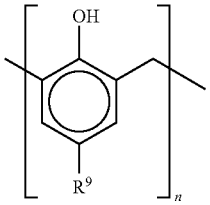

where $R^9$ is $C_1$-$C_{200}$-alkyl or -alkenyl, O—$R^{10}$ or O—C(O)—$R^{10}$, $R^{10}$ is $C_1$-$C_{200}$-alkyl or -alkenyl and n is from 2 to 100. $R^{10}$ is preferably $C_1$-$C_{24}$-alkyl or -alkenyl and in particular $C_4$-$C_{16}$-alkyl or -alkenyl, for example $C_6$-$C_{12}$-alkyl or -alkenyl. $R^9$ is more preferably $C_1$-$C_{24}$-alkyl or -alkenyl and in particular $C_4$-$C_{16}$-alkyl or -alkenyl, for example $C_6$-$C_{12}$-alkyl or -alkenyl. n is preferably from 2 to 50 and especially from 3 to 25, for example from 5 to 15.

These alkylphenol-aldehyde resins are obtainable by known processes, for example by condensing the corresponding alkylphenols with formaldehyde, i.e. with from 0.5 to 1.5 mol, preferably from 0.8 to 1.2 mol of formaldehyde per mole of alkylphenol. The condensation can be effected without solvent, but is preferably effected in the presence of a water-immiscible or only partly water-miscible inert organic solvent such as mineral oils, alcohols, ethers and the like. Particular preference is given to solvents which can form azeotropes with water. The solvents of this type used are in particular aromatics such as toluene, xylene, diethylbenzene and relatively high-boiling commercial solvent mixtures such as ®Shellsol AB, and Solvent Naphtha. Also suitable as solvents are fatty acids and derivatives thereof, for example esters with lower alcohols having from 1 to 5 carbon atoms, for example ethanol and especially methanol. The condensation is effected preferably between 70 and 200° C., for example between 90 and 160° C. It is typically catalyzed by from 0.05 to 5% by weight of bases or preferably by from 0.05 to 5% by weight of acids. As acidic catalysts, in addition to carboxylic acids such as acetic acid and oxalic acid, in particular strong mineral acids such as hydrochloric acid, phosphoric acid and sulfuric acid, and also sulfonic acids, are useful catalysts. Particularly suitable catalysts are sulfonic acids which contain at least one sulfonic acid group and at least one saturated or unsaturated, linear, branched and/or cyclic hydrocarbon radical having from 1 to 40 carbon atoms and preferably having from 3 to 24 carbon atoms. Particular preference is given to aromatic sulfonic acids, especially the alkylaromatic monosulfonic acids having one or more $C_1$-$C_{28}$-alkyl radicals and especially those having $C_3$-$C_{22}$-alkyl radicals. Suitable examples are methanesulfonic acid, butanesulfonic acid, benzenesulfonic acid, p-toluenesulfonic acid, xylenesulfonic acid, 2-mesitylenesulfonic acid, 4-ethylbenzenesulfonic acid, isopropylbenzene-sulfonic acid, 4-butylbenzenesulfonic acid, 4-octylbenzenesulfonic acid; dodecylbenzenesulfonic acid, didodecylbenzenesulfonic acid, naphthalenesulfonic acid. Mixtures of these sulfonic acids are also suitable. Typically, after the reaction has ended, they remain in the product as such or in neutralized form. For neutralization, preference is given to using amines and/or aromatic bases, since they can remain in the product; salts which comprise metal ions and hence form ash are usually removed.

Suitable comb polymers (constituent V) may, for example, be described by the formula

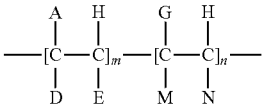

In this formula,

A is R', COOR', OCOR', R"-COOR', OR';

D is H, $CH_3$, A or R";

E is H, A;

G is H, R", R"-COOR', an aryl radical or a heterocyclic radical;

M is H, COOR", OCOR", OR", COOH;

N is H, R", COOR", OCOR", an aryl radical;

R' is a hydrocarbon chain having from 8 to 50 carbon atoms;

R" is a hydrocarbon chain having from 1 to 10 carbon atoms;

m is from 0.4 to 1.0; and n is from 0 to 0.6.

Suitable comb polymers are, for example, copolymers of ethylenically unsaturated dicarboxylic acids such as maleic acid or fumaric acid with other ethylenically unsaturated monomers such as olefins or vinyl esters, for example vinyl acetate. Particularly suitable olefins are α-olefins having from 10 to 24 carbon atoms, for example 1-decene, 1-dodecene, 1-tetradecene, 1-hexadecene, 1-octadecene and mixtures thereof. Suitable comonomers are also longer-chain olefins based on oligomerized $C_2$-$C_6$-olefins, for example poly(isobutylene) having a high proportion of terminal double bonds. Typically, these copolymers are esterified to an extent of at least 50% with alcohols having from 10 to 22 carbon atoms. Suitable alcohols include n-decan-1-ol, n-dodecan-1-ol, n-tetradecan-1-ol, n-hexadecan-1-ol, n-octadecan-1-ol, n-eicosan-1-ol and mixtures thereof. Particular preference is given to mixtures of n-tetradecan-1-ol and n-hexadecan-1-ol. Likewise suitable as comb polymers are poly(alkyl acrylates), poly(alkyl methacrylates) and poly(alkyl vinyl ethers) which derive from alcohols having from 12 to 20 carbon atoms, and also poly(vinyl esters) which derive from fatty acids having from 12 to 20 carbon atoms.

Suitable polyoxyalkylene compounds (constituent VI) are, for example, esters, ethers and ether/esters of polyols which bear at least one alkyl radical having from 12 to 30 carbon atoms. When the alkyl groups stem from an acid, the remainder stems from a polyhydric alcohol; when the alkyl radicals come from a fatty alcohol, the remainder of the compound stems from a polyacid.

Suitable polyols are polyethylene glycols, polypropylene glycols, polybutylene glycols and their copolymers having a molecular weight of from approx. 100 to approx. 5000 g/mol, preferably from 200 to 2000 g/mol. Also suitable are alkoxylates of polyols, for example of glycerol, trimethylolpropane, pentaerythritol, neopentyl glycol, and also the oligomers which are obtainable therefrom by condensation and have from 2 to 10 monomer units, for example polyglycerol. Preferred alkoxylates are those having from 1 to 100 mol, in particular from 5 to 50 mol, of ethylene oxide, propylene oxide and/or butylene oxide per mole of polyol. Esters are particularly preferred.

Fatty acids having from 12 to 26 carbon atoms are preferred for reaction with the polyols to form the ester additives, particular preference being given to using $C_{18}$- to $C_{24}$ fatty acids, especially stearic acid and behenic acid. The esters may also be prepared by esterifying polyoxyalkylated alcohols. Preference is given to fully esterified polyoxyalkylated polyols with molecular weights of from 150 to 2000, preferably from 200 to 600. PEG-600 dibehenate and glycerol-ethylene glycol tribehenate are particularly suitable.

Suitable olefin copolymers (constituent VII) as a further constituent of the inventive additive may derive directly from monoethylenically unsaturated monomers or be prepared indirectly by hydrogenating polymers which derive from polyunsaturated monomers such as isoprene or butadiene. Preferred copolymers contain, as well as ethylene, structural units which derive from α-olefins having from 3 to 24 carbon atoms and have molecular weights of up to 120 000 g/mol. Preferred α-olefins are propylene, butene, isobutene, n-hexene, isohexene, n-octene, isooctene, n-decene, isodecene. The comonomer content of α-olefins having from 3 to 24 carbon atoms is preferably between 15 and 50 mol %, more preferably between 20 and 35 mol % and especially between 30 and 45 mol %. These copolymers may also contain small amounts, for example up to 10 mol %, of further comonomers, for example nonterminal olefins or nonconjugated olefins. Preference is given to ethylene-propylene copolymers. The olefin copolymers can be prepared by known methods, for example by means of Ziegler or metallocene catalysts.

Further suitable olefin copolymers are block copolymers which contain blocks of olefinically unsaturated aromatic monomers A and blocks of hydrogenated polyolefins B. Particularly suitable block copolymers are those of the structure $(AB)_nA$ and $(AB)_m$, where n is from 1 to 10 and m is from 2 to 10.

The mixing ratio between the inventive additives and alkylphenol-aldehyde resins (constituent IV), comb polymers (constituent V), polyoxyalkylene compounds (constituent VI) and olefin copolymers (constituent VII) may vary according to the application. Such additive mixtures preferably contain, based on the active ingredients, in each case from 0.1 to 10 parts by weight, preferably from 0.2 to 5 parts by weight, of at least one alkylphenol-aldehyde resin, of a comb polymer, of a polyoxyalkylene compound and/or of an olefin copolymer per part by weight of the inventive additives. The inventive additives may be used alone or else together with other additives, for example with other pour point depressants or dewaxing assistants, with antioxidants, cetane number improvers, dehazers, demulsifiers, detergents, dispersants, defoamers, dyes, corrosion inhibitors, lubricity additives, sludge inhibitors, odorants and/or additives for lowering the cloud point.

The inventive additives are suitable for improving the cold flow properties of animal, vegetable and/or mineral fuel oils. At the same time, these additives have very low intrinsic pour points and their concentrated formulations in mineral oil-based solvents lead to clear formulations of low viscosity. This allows problem-free use of these additives, in particular under conditions under which the additives have to be used at low temperatures without any means of prior heating, as can occur, for example, in the case of use in remote regions in winter.

They are particularly suitable for improving the properties of mineral oils and mineral oil distillates such as jet fuel, kerosene, diesel and heating oil with low cloud points of below 0° C., especially below −10° C., for example below −15° C. or also below −20° C. For the purpose of lowering the sulfur content, they have frequently been subjected to refining under hydrogenating conditions and contain preferably less than 350 ppm of sulfur and in particular less than 100 ppm of sulfur, for example less than 50 ppm or 10 ppm of sulfur. In addition, these oils preferably contain less than 25% by weight, in particular less than 22% by weight, for example less than 20% by weight of aromatic compounds.

The inventive fuel oils preferably contain from 5 to 5000 ppm, more preferably from 10 to 2000 ppm and especially from 50 to 1000 ppm of at least one inventive terpolymer of ethylene, unsaturated ester and propene.

Middle distillates refer in particular to those mineral oils which are obtained by distilling crude oil and boil in the range from 120 to 450° C., for example kerosene, jet fuel, diesel and heating oil. The inventive compositions are particularly advantageous in those middle distillates which have 90% distillation points below 360° C., in particular above 350° C. and in special cases below 340° C. Middle distillates further comprise synthetic fuel oils which boil in the temperature range from about 120 to 450° C., and also mixtures of mineral and these synthetic middle distillates. Examples of synthetic middle distillates are especially fuels produced by the Fischer-Tropsch process from coal, natural gas or else biomass. In this case, synthesis gas is first prepared and converted to normal paraffins via the Fischer-Tropsch process. The normal paraffins thus prepared can subsequently be modified, for example, by catalytic cracking, isomerization, hydrocracking or hydroisomerization.

Aromatic compounds are understood to mean the sum of mono-, di- and polycyclic aromatic compounds, as can be determined by means of HPLC to DIN EN 12916 (Edition 2001).

The inventive additive mixtures are also particularly effective in middle distillates which contain minor amounts, for example up to 30% by volume, of oils of animal and/or vegetable origin. Examples of suitable oils of animal and/or vegetable origin are both triglycerides and esters derived therefrom with lower alcohols having from 1 to 5 carbon atoms, such as ethyl and especially methyl esters, which are obtainable, for example, from cotton, palm kernels, rape, soya, sunflower, tallow and the like.

EXAMPLES

Effectiveness of the Additives as Cold Flow Improvers

The superior effectiveness of the inventive additives for mineral oils and mineral oil distillates is described with reference to the CFPP test (Cold Filter Plugging Test to EN 116).

The following additives were used:

Characterization of the Ethylene Copolymers Used

Process A): in a continuous tubular reactor, ethylene, propene and vinyl acetate were copolymerized at 200 MPa and a peak temperature of 220° C. with addition of the molecular weight regulator specified in table 1. The polymer formed was removed from the reaction mixture and then freed of residual monomers.

Process B): in a continuous high-pressure autoclave, ethylene, vinyl acetate and propylene were copolymerized with addition of a 10% by weight solution of bis(2-ethylhexyl) peroxodicarbonate as an initiator and the molecular weight regulator specified in table 1. The polymer formed was removed from the reaction mixture and then freed of residual monomers.

For comparison, an ethylene vinyl-acetate copolymer (Ex. 24), a terpolymer of ethylene, vinyl acetate and propene according to EP 0 190 553 (Ex. 25), a terpolymer of ethylene, vinyl acetate and 4-methylpentene-1 according to EP 0 807 642 (Ex. 26), and a terpolymer of ethylene, vinyl acetate and isobutylene (Ex. 27) were employed.

The vinyl acetate content was determined by means of pyrolysis of the polymer which had been freed of residual monomers at 150° C./100 mbar. To this end, 100 mg of the polymer are dissociated thermally with 200 mg of pure polyethylene in a pyrolysis flask at 450° C. in a closed system under reduced pressure for 5 minutes, and the dissociation gases are collected in a 250 ml round-bottom flask. The acetic acid dissociation product is reacted with an $NaI/KIO_3$ solution, and the iodine released is titrated with $Na_2S_2O_3$ solution.

The total number of methyl groups in the polymer which do not stem from vinyl esters is determined by means of $^1H$ NMR spectroscopy at a measurement frequency of 500 MHz on 10 to 15% solutions in $C_2D_2Cl_4$ at 300 K. The integral of the methylprotons between about 0.7 and 0.9 ppm is determined as a ratio relative to that of the methylene and methine protons between about 0.9 and 1.9 ppm. A correction of the number of the methyl groups for the structural units which are derived from the moderator used and overlap with the signals of the main polymer chain is effected on the basis of the methine proton of the moderator which appears separately (for example, methyl ethyl ketone and propanal exhibit multiplets at 2.4 and 2.5 ppm).

The content of methyl groups which derive from propene is determined by means of $^{13}C$ NMR spectroscopy at a measurement frequency of 125 MHz on likewise 10 to 15% solutions in $C_2D_2Cl_4$ at 300 K. The integral of the methyl groups derived from propene between 19.3 and 20.2 ppm is determined as a ratio relative to that of the aliphatic hydrocarbons of the polymer backbone between 22 and 44 ppm. Advantageously, $^1H$ and $^{13}C$ NMR measurement is performed on the same sample.

The number of chain ends is determined by subtracting the number of methyl groups derived from propene, determined by means of $^{13}C$ NMR, from the total number of methyl groups, determined by means of $^1H$ NMR. The two values should be treated as dimensionless numbers.

To assess the cold flowability of concentrates which contain inventive additives, the abovementioned active substances were homogenized at 35% strength in a relatively high-boiling aromatic solvent (Solvent Naphtha) with stirring at 60° C. The pour point of the resulting concentrate was subsequently determined.

TABLE 1

Characterization of the polymers

| Polymer | Polymerization process/moderator | Vinyl acetate in the polymer [mol %] | Propene-$CH_3$ per 100 aliph. $CH_2$ | Number of chain ends | Total G | $V_{140}$ [mPas] | Pour point [° C.] |
|---|---|---|---|---|---|---|---|
| P1 | A/PA | 13.5 | 3.0 | 6.2 | 16.5 | 155 | −27 |
| P2 | B/PA | 13.4 | 2.6 | 4.7 | 16.0 | 182 | −33 |
| P3 | B/PA | 13.6 | 3.0 | 4.9 | 16.6 | 140 | −39 |
| P4 | B/PA | 12.2 | 3.1 | 5.2 | 15.3 | 115 | −36 |
| P5 | B/PA | 13.4 | 1.8 | 4.1 | 15.2 | 143 | −27 |
| P6 | B/PA | 14.9 | 1.6 | 4.6 | 16.5 | 148 | −30 |
| P7 | B/PA | 14.0 | 2.2 | 3.8 | 16.2 | 95 | −21 |
| P8 | B/PA | 13.8 | 2.8 | 3.9 | 16.6 | 90 | −27 |
| P9 | B/PA | 14.4 | 3.4 | 3.6 | 17.8 | 88 | −30 |
| P10 | B/PA | 13.5 | 2.3 | 3.4 | 15.8 | 103 | −18 |
| P11 | B/PA | 13.3 | 2.6 | 4.2 | 15.9 | 156 | −27 |
| P12 | B/PA | 13.8 | 3.1 | 4.4 | 16.9 | 147 | −33 |
| P13 | B/PA | 14.1 | 3.6 | 4.8 | 17.7 | 99 | −36 |
| P14 | A/MEK | 13.5 | 2.9 | 4.3 | 16.4 | 175 | −24 |
| P15 | A/MEK | 13.5 | 2.0 | 5.4 | 15.5 | 155 | −18 |
| P16 | A/MEK | 14.4 | 2.8 | 4.8 | 17.2 | 153 | −21 |
| P17 | A/MEK | 14.0 | 2.2 | 5.2 | 16.2 | 157 | −27 |
| P18 | B/PA | 14.3 | 2.2 | 3.6 | 16.5 | 97 | −21 |
| P19 | B/PA | 14.0 | 2.9 | 3.2 | 16.9 | 154 | −24 |
| P20 | B/MPK | 14.9 | 1.2 | 5.3 | 16.1 | 104 | −18 |
| P21 (comp.) | B/PA | 13.7 | 4.2 | 5.8 | 17.9 | 138 | −48 |
| P22 (comp.) | B/PA | 16.2 | 2.5 | 5.8 | 18.6 | 138 | −42 |
| P23 (comp.) | B/PA | 13.6 | 2.7 | 6.7 | 17.3 | 133 | −39 |
| P24 (comp.) | A/MEK | 13.3 | — | 4.6 | 13.3 | 125 | −9 |
| P25 (comp.) | B/— | 12.8 | 12.0 | 6.9 | 18.9 | 145 | −21 |
| P26 (comp.) | B/PA | 12.5 | 4.6 mol % of 4-MP-1 | n.a. | n.a. | 115 | −24 |
| P27 (comp.) | B/PA | 13.1 | 4.3 mol % of DIB | n.a. | n.a. | 122 | −27 |

PA = propionaldehyde;
MEK = methyl ethyl ketone;
MPK = methyl propyl ketone

TABLE 2

Characterization of the test oils:
The test oils used were current oils from European refineries. The CFPP value was determined to EN 116 and the cloud point to ISO 3015

| | Test oil 1 | Test oil 2 | Test oil 3 | Test oil 4 |
|---|---|---|---|---|
| Distillation | | | | |
| IBP [° C.] | 200 | 194 | 188 | 171 |
| 20% [° C.] | 251 | 249 | 232 | 218 |
| 90% [° C.] | 342 | 341 | 323 | 324 |
| FBP [° C.] | 357 | 355 | 355 | 351 |
| Cloud Point [° C.] | −4.2 | −5.6 | −18 | −5.4 |
| CFPP [° C.] | −6 | −7 | −20 | −8 |
| Density @ 15° C. [g/cm$^3$] | 0.8433 | 0.840 | 0.852 | 0.831 |

TABLE 3

Testing as a cold flow improver in test oil 1.

| Example | Polymer | Dosage rate 100 ppm | 200 ppm | 300 ppm |
|---|---|---|---|---|
| 1 | P1 | −7 | −10 | −18 |
| 2 | P2 | −11 | −14 | −17 |
| 3 | P3 | −10 | −18 | −20 |
| 4 | P4 | −11 | −19 | −21 |
| 5 | P7 | −11 | −20 | −21 |
| 6 | P8 | −11 | −16 | −21 |
| 7 | P9 | −7 | −12 | −18 |
| 8 | P10 | −12 | −22 | −21 |
| 9 | P11 | −10 | −17 | −21 |
| 10 | P12 | −9 | −17 | −20 |
| 11 | P13 | −11 | −19 | −21 |
| 12 | P14 | −10 | −19 | −19 |
| 13 | P15 | −11 | −18 | −21 |
| 14 | P16 | −12 | −20 | −22 |
| 15 | P17 | −10 | −18 | −19 |
| 16 | P18 | −12 | −19 | −21 |
| 17 | P19 | −11 | −20 | −22 |
| 18 | P20 | −10 | −17 | −20 |
| 19 | P21 (comp.) | −9 | −10 | −10 |
| 20 | P22 (comp.) | −7 | −7 | −8 |
| 21 | P23 (comp.) | −7 | −8 | −8 |
| 22 | P24 (comp.) | −11 | −17 | −19 |
| 23 | P25 (comp.) | −7 | −10 | −11 |
| 24 | P26 (comp.) | −8 | −10 | −13 |

TABLE 4

Testing as a cold flow improver in test oil 2

| Example | Polymer | Dosage rate 100 ppm | 200 ppm | 300 ppm |
|---|---|---|---|---|
| 25 | P1 | −9 | −14 | −18 |
| 26 | P2 | −11 | −19 | −21 |
| 27 | P4 | −10 | −15 | −21 |
| 28 | P5 | −11 | −19 | −20 |
| 29 | P6 | −10 | −17 | −20 |
| 30 | P7 | −11 | −19 | −21 |
| 31 | P8 | −11 | −18 | −21 |
| 32 | P9 | −10 | −16 | −20 |
| 33 | P16 | −10 | −16 | −20 |
| 34 | P17 | −11 | −17 | −20 |
| 35 | P20 | −10 | −14 | −20 |
| 36 | P21 (comp.) | −10 | −12 | −15 |
| 37 | P22 (comp.) | −11 | −12 | −15 |
| 38 | P23 (comp.) | −11 | −11 | −13 |
| 39 | P24 (comp.) | −10 | −18 | −20 |
| 40 | P25 (comp.) | −10 | −11 | −15 |
| 41 | P27 (comp.) | −11 | −13 | −17 |

The effectiveness of the inventive terpolymers in test oil 2 was determined in combination of 75% by weight of the inventive polymers with 25% by weight of an ethylene copolymer with 24% by weight of vinyl acetate and a melt viscosity measured at 140° C. of 280 mPas.

The effectiveness of the inventive terpolymers was determined in test oils 3 and 4 in a combination of 85% by weight of the inventive polymers with 15% by weight of a condensate of alkylphenol and formaldehyde having a mean molecular weight of 12 000 g/mol.

TABLE 5

Testing as a cold flow improver in test oil 3

| Example | Polymer | Dosage rate 25 ppm | 50 ppm | 100 ppm |
|---|---|---|---|---|
| 42 | P2 | −33 | −35 | −36 |
| 43 | P6 | −33 | −34 | −37 |
| 44 | P7 | −34 | −33 | −36 |
| 45 | P8 | −34 | −35 | −38 |
| 46 | P14 | −33 | −34 | −35 |
| 47 | P16 | −34 | −34 | −35 |
| 48 | P17 | −32 | −33 | −35 |
| 49 | P19 | −35 | −38 | −39 |
| 50 | P25 (comp.) | −25 | −27 | −28 |
| 51 | P27 (comp.) | −29 | −31 | −32 |

TABLE 6

Testing as a cold flow improver in test oil 4

| Example | Polymer | Dosage rate 300 ppm | 400 ppm | 500 ppm |
|---|---|---|---|---|
| 52 | P4 | −12 | −12 | −18 |
| 53 | P5 | −12 | −18 | −19 |
| 54 | P6 | −12 | −19 | −20 |
| 55 | P7 | −19 | −19 | −19 |
| 56 | P8 | −17 | −20 | −18 |
| 57 | P11 | −12 | −19 | −19 |
| 58 | P12 | −12 | −18 | −18 |
| 59 | P13 | −12 | −15 | −18 |
| 60 | P15 | −12 | −14 | −16 |
| 61 | P16 | −12 | −17 | −19 |
| 62 | P22 (comp.) | −11 | −12 | −12 |
| 63 | P23 (comp.) | −11 | −11 | −12 |
| 64 | P26 (comp.) | −11 | −13 | −15 |

The experiments show that the inventive additives, with regard to the improvement in the cold flowability and especially the lowering of the CFPP of middle distillates are superior to the prior art additives. At the same time, their concentrates are usable at relatively low temperatures as corresponding copolymers of ethylene and vinyl esters.

The invention claimed is:

1. A polymer of ethylene, a single ethylenically unsaturated ester and propene, which comprises:

a) from 12.0 to 16.0 mol% of structural units derived from the single ethylenically unsaturated ester, b) from 1.0 to 4.0 methyl groups derived from propene per 100 aliphatic carbon atoms, determined by $^{13}C$ NMR spectroscopy, and c) fewer than 6.5 methyl groups stemming from chain ends per 100 $CH_2$groups, wherein the polymer has a sum G of molar content of unsaturated ester a) and the number of methyl groups derived from propene per 100 aliphatic carbon atoms of the polymer b), according to the formula $$G=[\text{mol \% of unsaturated ester}]+[\text{propene-}CH_3]$$

and wherein G is between 14.5 and 18.0.

2. The polymer as claimed in claim 1, in which the ethylenically unsaturated ester is the vinyl ester of a carboxylic acid having from 2 to 12 carbon atoms.

3. The polymer of claim 1, in which the ethylenically unsaturated ester is vinyl acetate.

4. The polymer as claimed in claim 3, in which the polymer comprises between 28.0 and 36.0% by weight of the vinyl acetate.

5. The polymer of claim 1, which further comprises structural units derived from at least one moderator having a carbonyl group.

6. The polymer as claimed in claim 5, which further comprises from 0.5 to 7.0% by weight of at least one structural unit derived from a moderator comprising carbonyl groups.

7. A process for preparing the polymer of claim 1, by reacting a mixture of ethylene, propene and the single ethylenically unsaturated ester under elevated pressure and elevated temperature in the presence of a free radical-forming initiator, and in which the molecular weight is adjusted by a moderator comprising carbonyl groups.

8. The process as claimed in claim 7, in which a high-pressure bulk polymerization is performed at the elevated pressure of at least 100 MPa.

9. The process as claimed in claim 7, in which a high-pressure bulk polymerization is performed at a peak temperature below 220° C.

10. A composition comprising at least one polymer as claimed in claim 1 and at least one further ethylene copolymer.

11. The composition as claimed in claim 10, wherein the total comonomer content of the further ethylene copolymer is at least two mol % lower than that of the at least one polymer.

12. A composition comprising at least one polymer as claimed in claim 1 and at least one oil-soluble polar nitrogen compound.

13. A composition comprising at least one polymer as claimed in claim 1 and at least one alkylphenol-aldehyde resin.

14. A composition comprising at least one polymer as claimed in claim 1 and at least one comb polymer.

15. The composition comprising at least one polymer as claimed in claim 1, and at least one polyoxyalkylene compound.

16. A free-flowing additive concentrate having an intrinsic pour point of −10° C. or lower for improving the flowability of middle distillates, said concentrate containing 20-40% by weight of at least one polymer as claimed in claims 1 and 60-80% by weight of at least one solvent.

17. A process for improving the cold flow properties of a fuel oil, by adding to the fuel oil a formulation containing at least 20% by weight of at least one polymer as claimed in claim 1 at a temperature of 0° C. or lower.

18. A fuel oil comprising a middle distillate and at least one polymer as claimed in claim 1.

19. The composition of claim 1, further comprising at least one component selected from the group consisting of a further ethylene copolymer, an oil-soluble polar nitrogen compound, an alkylphenol-aldehyde resin, a comb polymer, a polyoxyalkylene compound, and mixtures thereof.

* * * * *